US007319444B2

(12) United States Patent
Jo

(10) Patent No.: US 7,319,444 B2
(45) Date of Patent: Jan. 15, 2008

(54) PIXEL CIRCUIT, ELECTRO-OPTICAL DEVICE, AND ELECTRONIC APPARATUS

(75) Inventor: Hiroaki Jo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 730 days.

(21) Appl. No.: 10/813,273

(22) Filed: Mar. 31, 2004

(65) Prior Publication Data

US 2004/0239661 A1 Dec. 2, 2004

(30) Foreign Application Priority Data

Mar. 31, 2003 (JP) ..... 2003-095963

(51) Int. Cl.
*G09G 5/00* (2006.01)

(52) U.S. Cl. ..... 345/76; 345/204; 315/169.3

(58) Field of Classification Search ..... 257/13; 345/90, 204, 76–83, 211; 315/169.1–169.4
See application file for complete search history.

(56) References Cited

U.S. PATENT DOCUMENTS 6,462,722 B1 * 10/2002 Kimura et al. ..... 345/76
6,518,962 B2 * 2/2003 Kimura et al. ..... 345/211
6,650,060 B2 * 11/2003 Okuda ..... 315/169.1
6,812,651 B2 * 11/2004 Iwata et al. ..... 315/169.3
2002/0125831 A1 * 9/2002 Inukai et al. ..... 315/169.3

FOREIGN PATENT DOCUMENTS

| | | |
|---|---|---|
| JP | A-11-272223 | 10/1999 |
| JP | A-2002-215095 | 7/2002 |
| JP | A-2002-351403 | 12/2002 |
| WO | WO 98/36406 | 8/1998 |
| WO | WO 98/40871 A1 | 9/1998 |
| WO | WO 02/077957 A1 | 10/2002 |

* cited by examiner

*Primary Examiner*—Amare Mengistu
*Assistant Examiner*—Jennifer Zubajlo
(74) *Attorney, Agent, or Firm*—Oliff & Berridge, PLC

(57) ABSTRACT

To prevent degradation of quality of a displayed image by maintaining the flow of current at a constant value even when organic EL elements are degraded, a pixel circuit includes a capacitor that accumulates, when a scanning line is selected, charge in accordance with current flowing through a data line; a TFT that allows, subsequent to the selection, current $I_2$ in accordance with the accumulated charge to flow between the source and drain of the TFT; an organic EL element whose anode is connected to the drain of the TFT; a TFT that detects a voltage applied to the organic EL element and allows current $I_3$ in accordance with the applied voltage to flow between the source and drain of the TFT; and a correction circuit that generates mirror current $I_4$ of the current $I_3$ and adds the current $I_4$ to the current $I_2$.

18 Claims, 11 Drawing Sheets

PIXEL CIRCUIT, ELECTRO-OPTICAL DEVICE, AND ELECTRONIC APPARATUS

BACKGROUND OF THE INVENTION

1. Field of Invention

The present invention relates to pixel circuits to manage the aging of current-driven elements, such as organic EL (Electronic luminescence) elements, to electro-optical devices, and to electronic apparatuses.

2. Description of Related Art

Recently, attention has been paid to organic EL elements serving as next-generation light-emitting devices to replace known LCD (Liquid Crystal Display) elements. Since the organic EL elements are natural light elements that emit light in proportion to current, the organic EL elements have less dependence on the angle of view and require no backlight, thereby consuming low power. The organic EL elements have superior characteristics to serve as a display panel.

Methods to drive the organic EL elements, as in the LCD elements, are largely classified into an active matrix method using active elements, such as thin film transistors (hereinafter "TFTs") and a passive matrix method not using such active elements. The former method or the active matrix method is regarded as superior because of low drive voltage and the like.

Unlike the LCD elements, the organic EL elements have no voltage-holding characteristics. Therefore, once the current flow stops, the organic EL elements cannot maintain a light-emitting state. To prevent such a problem, voltage is accumulated in each capacitor and current is allowed to flow continuously through each organic EL element by a drive transistor having a gate to which the accumulated voltage is applied. See International Publication WO98/36406 Pamphlet.

SUMMARY OF THE INVENTION

The organic EL elements tend to be degraded due to aging or the like. Specifically, the necessary voltage to allow a constant current to flow through the organic EL elements tends to increase in accordance with time. Due to such a voltage increase, the current flowing through the organic EL elements is reduced below a target value. As a result, the organic EL elements cannot emit light with sufficient brightness, thereby degrading the quality of a displayed image. Incidentally, the necessary voltage to allow the constant current to flow through the organic EL elements also changes due to changes in ambient temperature.

In view of these circumstances, the present invention provides a pixel circuit capable of reducing or preventing degradation of the quality of a displayed image even when the necessary voltage to allow a constant current to flow through current-driven elements, such as organic EL elements changes due to degradation or ambient temperature, and to provide an electro-optical device and an electronic apparatus.

In order to achieve the foregoing, a pixel circuit according to an aspect of the present invention is a pixel circuit disposed at the intersection of a scanning line and a data line. The pixel circuit includes a capacitor that accumulates, when the scanning line is selected, charge in accordance with current flowing through the data line or voltage on the data line; a drive transistor being turned ON/OFF in accordance with the charge accumulated in the capacitor, the drive transistor allowing current to flow between a first terminal and a second terminal of the drive transistor; a driven element whose one end is electrically connected to the first terminal, the driven element being driven at least by the current allowed to flow by the drive transistor; a detector that detects voltage at one end of the driven element; and a correction circuit that corrects the current flowing through the driven element in accordance with the absolute value of the voltage detected by the detector. According to this structure, since the current by the drive transistor is corrected by the correction circuit, the current flowing through the driven element is made substantially equal to a target value or the current flowing through the data line or the current associated with the voltage on the data line even when the driven element becomes degraded.

In this structure, the correction circuit may generate current in accordance with the voltage detected by the detector and may add the generated current to the current allowed to flow by drive transistor. When the current is added in this manner, the detector may be a detection transistor whose gate is connected to one end of the driven element, the detection transistor being turned ON/OFF in accordance with the gate voltage thereof, and the detection transistor allowing current to flow between a third terminal and a fourth terminal thereof. The correction circuit may generate current associated with current flowing between a first terminal and a second terminal of the detection transistor. In this case, the correction circuit may be a current mirror circuit that generates a mirror current of the current flowing between the third terminal and the fourth terminal. Incidentally, the mirror current includes current of the same value as that flowing between the third terminal and the fourth terminal and current in equal ratio of that flowing between the third terminal and the fourth terminal.

When the current is added, the correction circuit may invert and amplify the voltage detected by the detector and may apply the inverted, amplified voltage to the driven element. When the current is added, the pixel circuit may further include a switch whose one end is connected to the first terminal and whose other end is connected to one end of the driven element, the switch controlling the connection between the drive transistor and the driven element when the scanning line is unselected. The detector may detect voltage at one end of the switch, and the correction circuit may allow the generated current to flow through one end of the switch.

In this structure, the pixel circuit may further include a switching transistor being turned ON when the scanning line is selected; and a compensation transistor for diode-connecting the drive transistor when the scanning line is selected. The capacitor may accumulate, when the switching transistor is turned ON, the charge in accordance with the current flowing through the data line. The pixel circuit may further include a switching transistor being turned ON when the scanning line is selected. The capacitor may accumulate, when the switching transistor is turned ON, the charge in accordance with the voltage on the data line.

According to an aspect of the present invention, advantages similar to those achieved by the structure in which the current is added may be achieved also by voltage adjustment. For example, in this structure, the correction circuit may adjust, when the absolute value of the voltage detected by the detector is large, voltage between the first terminal or the second terminal of the drive transistor and the other end of the driven element by increasing the voltage in terms of absolute value.

In order to achieve the foregoing, another pixel circuit according to an aspect of the present invention is a pixel circuit including a drive transistor whose gate is connected to one end of a capacitor, and the connection between a first terminal and a second terminal of the drive transistor being set in accordance with charge accumulated in the capacitor; a driven element whose one end is electrically connected to the first terminal; a detector that detects voltage at one end of the driven element; and a correction circuit including an input end to receive a signal indicating the voltage detected by the detector and an output end electrically connected to the first terminal, the correction circuit supplying current in accordance with the absolute value of the voltage indicated by the signal input to the input end to the output end. With this structure, since the current by the drive transistor is corrected by the correction circuit, the current flowing through the driven element is made substantially equal to a target value or the current flowing through the data line or the current associated with the voltage on the data line even when the driven element becomes degraded.

In this structure, the detector may be a detection transistor whose gate is connected to one end of the driven element, and the connection between a third terminal and a fourth terminal of the detection transistor may be set in accordance with the gate voltage thereof.

When using such a detection transistor, the correction circuit may include a first transistor whose fifth terminal is connected to the gate, whose sixth terminal is connected to a power-supply-voltage feed line, and the fifth terminal is connected to the third terminal; and a second transistor whose gate is connected to the gate of the first transistor and the fifth terminal, whose seventh terminal is electrically connected to the first terminal, and whose eighth terminal is connected to the feed line. Alternatively, the correction circuit may include a third transistor, a reference voltage being applied to the gate thereof, a ninth terminal thereof being connected to the third terminal, and a tenth terminal thereof being connected to a power-supply-voltage feed line; and a fourth transistor whose gate is connected to the ninth terminal, whose eleventh terminal is electrically connected to the first terminal, and whose twelfth terminal is connected to the feed line.

The pixel circuit may further include a switch whose one end is connected to the first terminal, and whose other end is connected to one end of the driven element. The detector may detect voltage at one end of the switch. The pixel circuit may further include a compensation transistor that short-circuits between the gate of the drive transistor and the first terminal. The capacitor may accumulate charge in accordance with the voltage at the first terminal when the compensation transistor short-circuits between the gate of the drive transistor and the first terminal.

In order to achieve the foregoing, a first electro-optical device according to an aspect of the present invention includes a plurality of data lines, a plurality of scanning lines, and a plurality of pixel circuits described above, the pixel circuits being disposed at the intersections of the plural data lines and the plural scanning lines.

In order to achieve the foregoing, a second electro-optical device according to an aspect of the present invention includes pixel circuits disposed at the intersections of a plurality of scanning lines and a plurality of data lines, the pixel circuits including driven elements; a scanning-line drive circuit that selects the scanning lines one at a time; and a data-line drive circuit that supplies, when the scanning line is selected by the scanning-line drive circuit, current that is to flow through the driven element of each corresponding pixel circuit associated with the scanning line or voltage associated with the current via each corresponding data line. Each of the pixel circuits includes a capacitor that accumulates, when the corresponding scanning line is selected, charge in accordance with current flowing through the corresponding data line or voltage on the corresponding data line; a drive transistor being turned ON/OFF in accordance with the charge accumulated in the capacitor, the drive transistor allowing current to flow between a first terminal and a second terminal of the drive transistor; a driven element whose one end is electrically connected to the first terminal, the driven element being driven by at least the current allowed to flow by the drive transistor; a detector that detects voltage at one end of the driven element; and a correction circuit that corrects the current flowing through the driven element in accordance with the absolute value of the voltage detected by the detector. According to this structure, since the current by the drive transistor is corrected by the correction circuit, the current flowing through the driven element is made substantially equal to a target value or the current flowing through the data line or the current associated with the voltage on the data line even when the driven element becomes degraded.

Preferably, an electronic apparatus according to an aspect of the present invention includes this electro-optical device.

DETAILED DESCRIPTION OF PREFERRED EXEMPLARY EMBODIMENTS

Figure 1:
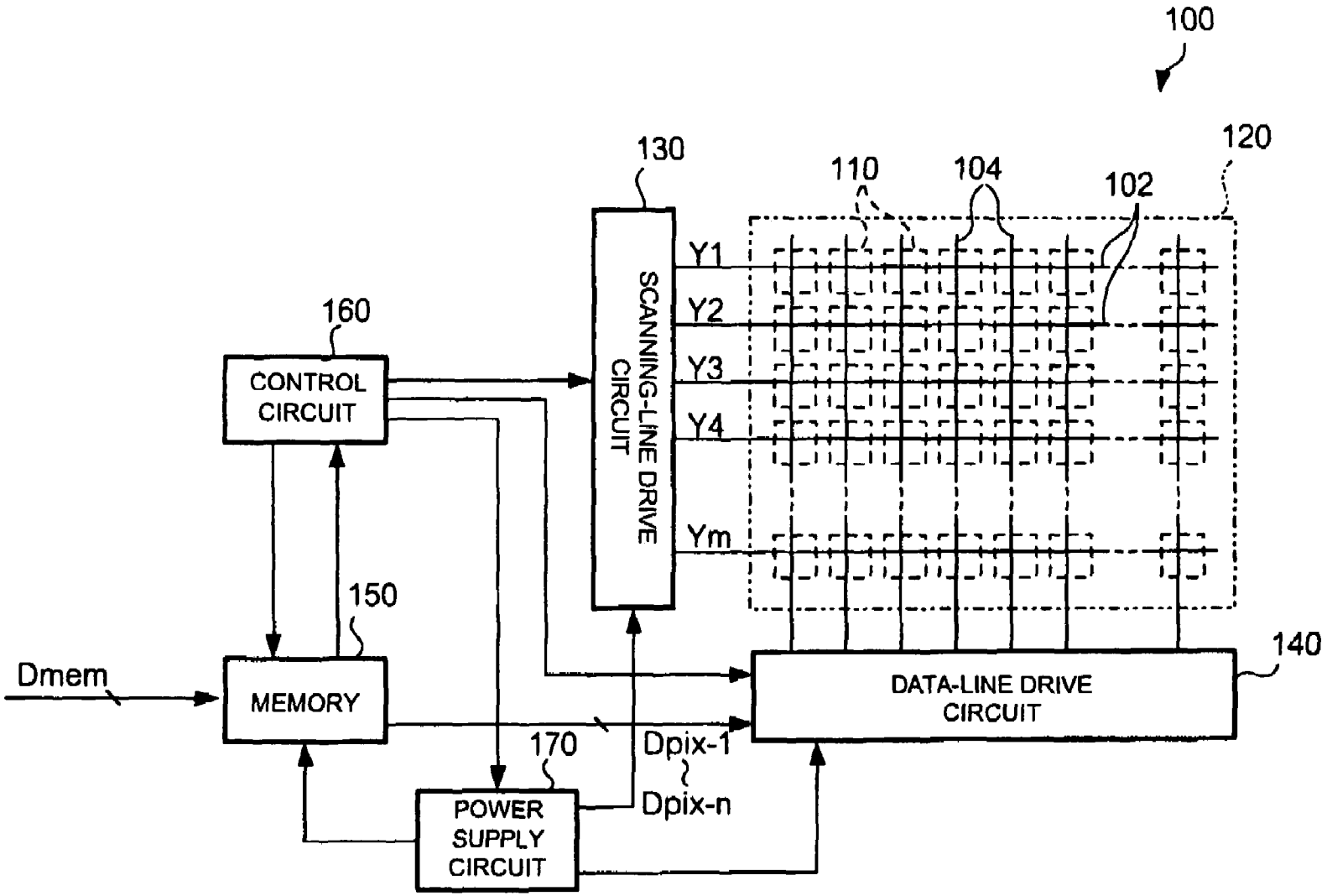
FIG. 1 is a block schematic of an electro-optical device according to an exemplary embodiment of the present invention.

With reference to the figures, the exemplary embodiments of the present invention will be described. Electro-optical Device FIG. 1 is a block schematic showing the structure of an electro-optical device according to an exemplary embodiment.

As shown in the figure, an electro-optical device 100 includes a display panel 120 provided with m scanning lines 102 and n data lines 104, which are orthogonal to each other (electrically insulated from each other), and pixel circuits 110 disposed at the intersections of the scanning lines 102 and the data lines 104; a scanning-line drive circuit 130 that drives the individual scanning lines 102; a data-line drive circuit 140 that drives the individual data lines 104; a memory 150 to store digital data Dmem which is supplied from an external device, such as a computer, and which defines the gray levels of individual pixels of an image to be displayed; a control circuit 160 that controls each part; and a power supply circuit 170 that supplies power to each part.

Figure 2:
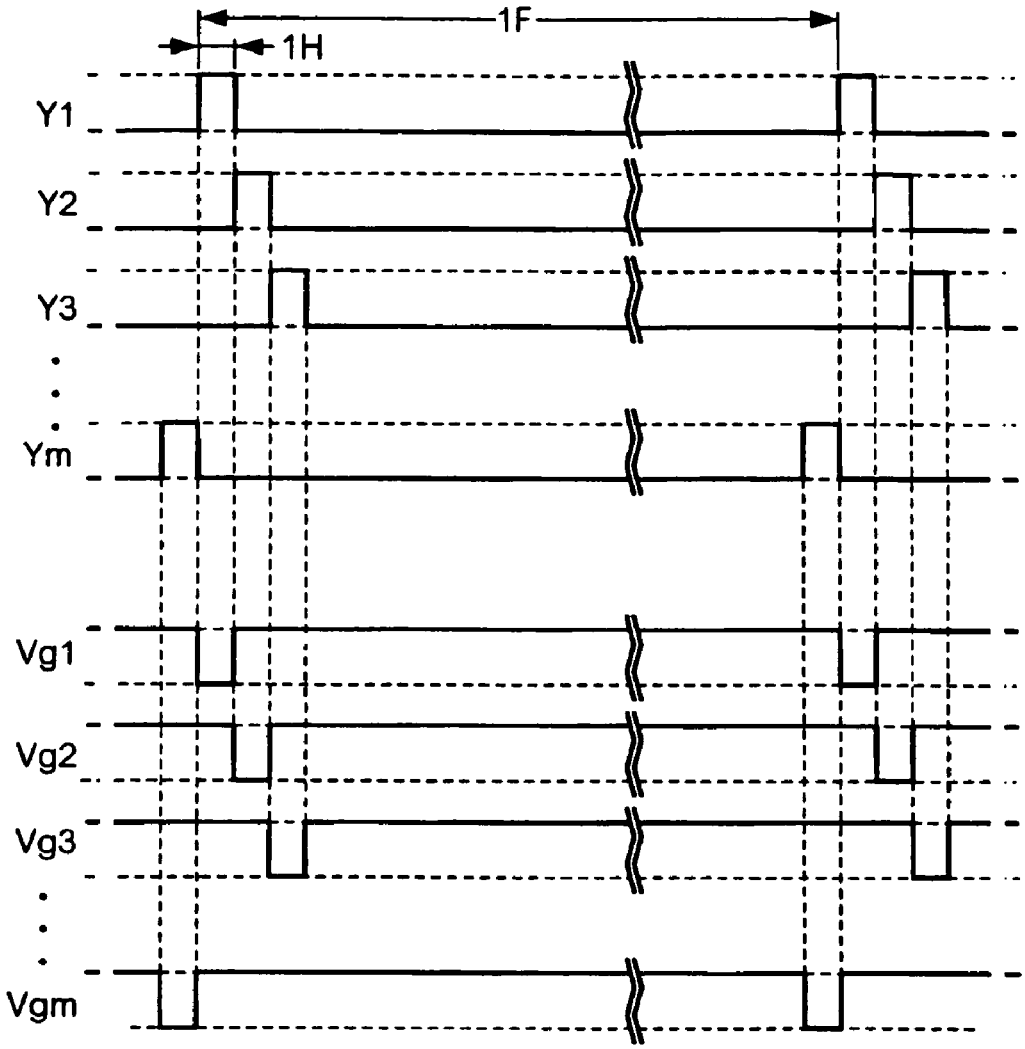
FIG. 2 is an operation chart of a scanning-line drive circuit of the electro-optical device.

The scanning-line drive circuit 130 generates scan signals Y1, Y2, Y3, . . . , Ym to select the scanning lines 102 one at a time, in turn. Specifically, as shown in FIG. 2, the scanning-line drive circuit 130 supplies, as the scan signal Y1, a pulse having a width corresponding to one horizontal scan period (1 H) starting from the beginning of a vertical scan period (1 F) to the first scanning line 102. From this point onward, the scanning-line drive circuit 130 sequentially shifts this pulse and supplies the resultant pulse as the scan signals Y2, Y3, . . . , Ym to the second, third, . . . , m-th scanning lines 102, respectively. In general, when the scan signal Yi supplied to the i-th scanning line 102 (where i is an integer that satisfies 1i≦≦m) becomes an H level, it means that this scanning line 102 is selected.

In addition to the scan signals Y1, Y2, Y3, . . . , Ym, the scanning-line drive circuit 130 generates light-emitting control signals Vg1, Vg2, Vg3, . . . , Vgm by inverting the logical level of the scan signals Y1, Y2, Y3, . . . , Ym and supplies the light-emitting control signals Vg1, Vg2, Vg3, . . . , Vgm to the display panel 120. Signal lines to which these light-emitting control signals are supplied are not shown in FIG. 1.

The control circuit 160 controls selection of the scanning line 102 by the scanning-line drive circuit 130 and, in synchronization with the selection of the scanning line 102, reads digital data Dpix-1 to Dpix-n associated with the first to n-th data lines 104 and supplies the digital data Dpix-1 to Dpix-n to the data-line drive circuit 140.

Figure 3:
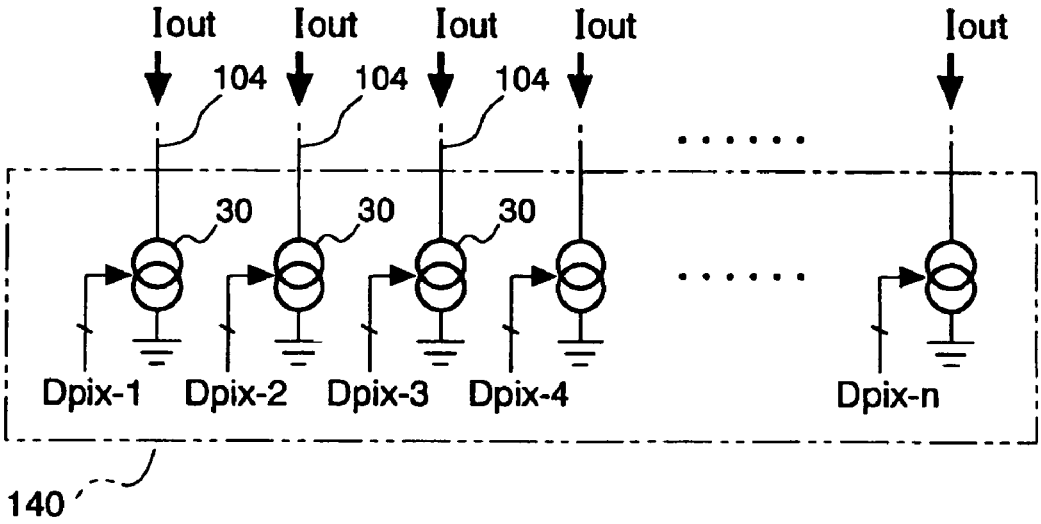
FIG. 3 is a schematic showing a data-line drive circuit of the electro-optical device.

As shown in FIG. 3, the data-line drive circuit 140 has current generation circuits 30 associated with the individual data lines 104. In general, the digital data Dpix-j associated with the intersection of the selected scanning line 102 and the j-th data line 104 is supplied to the j-th current generation circuit 30 (where j is an integer that satisfies 1≦j ≦n). This current generation circuit 30 generates current Iout in accordance with the digital value of the supplied digital data Dpix-j and allows this current Iout to flow through the corresponding j-th data line 104. For example, the current generation circuit 30 associated with the third data line 104 generates current Iout in accordance with the digital value of the digital data Dpix-3 associated with the intersection of the selected scanning line 102 and the third data line 104 and allows this current Iout to flow through the third data line 104.

In the electro-optical device 100, the elements denoted by reference numerals 120, 130, 140, 150, 160, and 170 may be independent elements. Alternatively, some or all of the elements may be integrated (e.g., the scanning-line drive circuit 130 and the data-line drive circuit 140 may be integrated; or some or all of the elements excluding the display panel 120 may be implemented using a programmable IC chip, and functions of these elements may be implemented in terms of software by a program written in the IC chip). These elements may be commercially available in various forms.

Pixel Circuit

Figure 4:
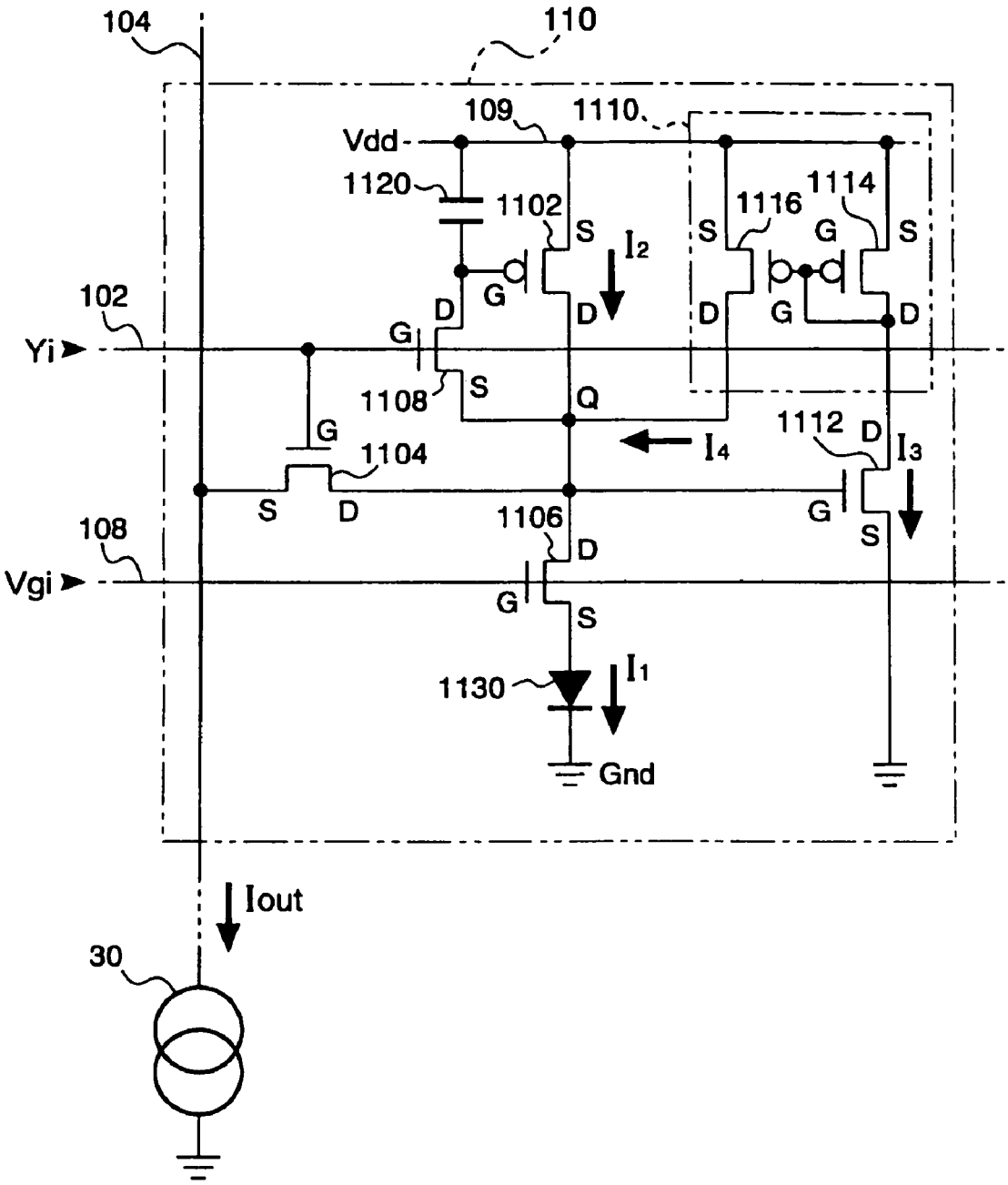
FIG. 4 is a schematic showing a pixel circuit of the electro-optical device.

The pixel circuits 110 in the electro-optical device 100 will now be described. FIG. 4 is a circuit schematic of the structure of one pixel circuit 110. In this exemplary embodiment, all the pixel circuits 110 have the same structure. To describe one typical pixel circuit 110, the pixel circuit 110 disposed at the intersection of the i-th scanning line 102 and the j-th data line 104 will now be described.

As shown in this schematic, the pixel circuit 110 disposed at the intersection of this scanning line 102 and this data line 104 includes seven thin-film transistors (hereinafter "TFTs") 1102, 1104, 1106, 1108, 1112, 1114, and 1116; a capacitor 1120; and an organic EL element 1130. Of these elements, the TFTs 1114 and 1116 are included in a correction circuit 1110 described later.

In the pixel circuit 110, the source of the p-channel TFT (drive transistor) 1102 is connected to a power line 109 to which voltage Vdd, which is a higher potential of the power supply, is applied. At the same time, the drain of the TFT 1102 is connected to Q point, that is, the drain of the n-channel TFT (switching transistor) 1104, the drain of the n-channel TFT (lighting switch) 1106, the source of the n-channel TFT (compensation transistor) 1108, the gate of the n-channel TFT 1112, and-the drain of the p-channel TFT 1116.

One end of the capacitor 1120 is connected to the power line 109, whereas the other end of the capacitor 1120 is connected to the gate of the TFT 1102 and the drain of the TFT 1108. The capacitor 1120 is provided to maintain the gate voltage of the TFT 1102 when the scanning line 102 is selected, which will be described below. Since one end of the capacitor 120 is only required to be at a constant potential, this end may be grounded, instead of being connected to the power line 109.

The gate of the TFT 1104 is connected to the scanning line 102, and the source of the TFT 1104 is connected to the data line 104. The gate of the TFT 1108 is connected to the scanning line 102.

At the same time, the gate of the TFT 1106 is connected to a light-emitting control line 108, whereas the source of the TFT 1106 is connected to the anode of the organic EL element 1130. The scanning-line drive circuit 130 supplies the light-emitting control signal Vgi to the light-emitting control line 108. The organic EL element 1130 includes an organic EL layer held between the anode and the cathode and emits light with brightness in accordance with forward current. The cathode of the organic EL element 1130 serves as a common electrode for all the pixel circuits 110 and is grounded at lower (reference) voltage Gnd of the power supply.

The source of the TFT 1112 is grounded at the lower voltage Gnd. At the same time, the source of the p-channel TFT 1114 included in the correction circuit 1110 is connected to the power line 109. The drain and gate of the TFT 1114 are commonly connected to the drain of the TFT 1112. At the same time, the source of the TFT 1116 is connected to the power line 109, whereas the gate of the TFT 1116 is connected to the common connection of the drain and gate of the TFT 1114.

Since the drain and gate of the TFT 1114 are commonly connected, the TFT 1114 functions as a diode. Since the gate of the TFT 1116 is connected to the common connection of the drain and gate of the TFT 1114, the TFTs 1114 and 1116 have the same transistor characteristics (current gain). In such a case, the TFTs 1114 and 1116 function as a current mirror circuit that allows mirror current $I_4$, which is the same as current $I_3$ flowing between the source and drain of the TFT 1114 (1112), to flow between the source and drain of the TFT 1116.

The operation of the pixel circuit 110, assuming that there is no correction circuit 1110, will now be described.

When the i-th scanning line 102 is selected, and when the scan signal Yi becomes an H level, the source and drain of the n-channel TFT 1108 are electrically connected (turned ON). As a result, the TFT 1102, whose gate and drain are interconnected, functions as a diode. When the scan signal Yi supplied to the scanning line 102 becomes an H level, the n-channel TFT 1104 enters a conducting state (ON), as in the TFT 1108. As a result, the current Iout generated by the current generation circuit 30 flows through the power line 109, the TFT 1102, the TFT 1104, and the data line 104 in this order, and charge in accordance with the gate voltage of the TFT 1102 is accumulated in the capacitor 1120.

When the selection of the i-th scanning line 102 is terminated and the i-th scanning line 102 becomes unselected, and when the scan signal Yi becomes an L level, both the TFTs 1104 and 1108 enter a non-conducting state (OFF). Since the charge accumulated in the capacitor 1120 remains unchanged, the gate of the TFT 1102 is maintained at the voltage when the current Iout has flowed through the TFT 1102.

When the scan signal Yi becomes the L level, the light-emitting control signal Vgi becomes an H level. As a result, the n-channel TFT 1106 is turned ON, and current in accordance with the gate voltage of the TFT 1102 flows between the source and drain of the TFT 1102. Specifically, this current flows through the power line 109, the TFT 1102, the TFT 1106, and the organic EL element 1130 in this order. Accordingly, the organic EL element 1130 emits light with brightness in accordance with the current value.

First, the current flowing through the organic EL element 1130 is determined by the gate voltage of the TFT 1102. This gate voltage is the voltage maintained by the capacitor 1120 when the current Iout has flowed through the data line 104 in response to the H-level scan signal. When the light-emitting control signal Vgi becomes the H level, ideally the current flowing through the organic EL element 1130 substantially agrees with the current Iout flowing through the organic EL element 1130 immediately before the light-emitting control signal Vgi becomes the H level.

However, since the structure includes no correction circuit 1110, the current flowing through the organic EL element 1130 when the light-emitting control signal Vgi becomes the H level disagrees with the current Iout generated by the current generation circuit 30 due to reasons described below.

Specifically, the current Iout generated by the current generation circuit 30 is a target value when the organic EL element 1130 is not degraded. Actually, when the organic EL element 1130 is degraded due to the time elapsed since manufacture, the necessary voltage to allow a constant current to flow through the organic EL element 1130 is increased. When the voltage between the terminals of the organic EL element 1130 is increased due to degradation, the voltage between the source and drain of the TFT 1102 is reduced by that amount. The current between the source and drain of a TFT is very apt to depend on the voltage between the source and drain of the TFT even in a saturation region.

When the light-emitting control signal Vgi becomes the H level, and when the TFT 1106 is turned ON, the voltage between the source and drain of the TFT 1102 is reduced below the value when the scan signal Yi becomes the H level and when the TFT 1104 is turned ON. Therefore, the current flowing through the organic EL element 1130 is insufficient compared to the target value, that is, the current Iout.

With the structure including no correction circuit 1110, therefore, the current flowing through the organic EL element 1130 when the light-emitting control signal Vgi becomes the H level is reduced below the current Iout generated by the current generation circuit 30. Accordingly, the current flowing through the organic EL element 1130 disagrees with the target value, that is, the current Iout.

The present exemplary embodiment including the correction circuit 1110 will now be described. Since the gate of the TFT 1112 is connected to the drain of the TFT 1102, the current $I_3$ flowing between the source and drain of the TFT 1112 is increased when the voltage between the source and drain of the TFT 1102 is reduced due to degradation of the organic EL element 1130.

As described above, since the TFTs 1114 and 1116 function as the current mirror circuit, the current $I_4$ flowing between the source and drain of the TFT 1116 agrees with the current $I_3$. This current $I_4$ is added to current $I_2$ flowing through the TFT 1102 at Q point, thereby allowing the sum of the current $I_4$ and the current $I_2$ to flow through the organic EL element 1130.

According to the present exemplary embodiment, when the light-emitting control signal Vgi becomes the H level, and when the current $I_2$ flowing between the source and drain of the TFT 1102 is reduced below the current Iout generated by the current generation circuit 30 due to degradation of the organic EL element 1130, insufficient current is compensated for by the current $I_4$. Accordingly, current $I_1$ flowing through the organic EL element 1130 is made substantially equal to the target value, that is, the current Iout. Even when there is a change in ambient temperature, the current flowing through the organic EL element 1130 is similarly made substantially equal to the current Iout.

Even when the TFTs 1102 of all the pixel circuits 110 have variations in characteristics, the same amount of current can be supplied to the organic EL elements 1130 included in the pixel circuits 110. Therefore, display unevenness due to these variations is suppressed.

One pixel circuit 110 has been described above. Since the i-th scanning line 102 is shared by m pixel circuits 110, these m pixel circuits 110 sharing the i-th scanning line 102 operate in a similar manner when the scan signal Yi becomes the H level.

As shown in FIG. 2, the scan signals Y1, Y2, Y3, . . . , Ym exclusively become the H level in turn. As a result, all the pixel circuits 110 operate in a similar manner, thereby displaying an image in one frame. This display operation is repeated every vertical scan period.

In the pixel circuit 110 shown in FIG. 4, the TFTs 1114 and 1116 have the same transistor characteristics. Alternatively, the TFTs 1114 and 1116 may have different current gains (β). When $\beta_1$ and $\beta_2$ are the current gains of the TFTs 1114 and 1116, the current $I_4$ is $\beta_2/\beta_1$ times the current $I_3$.

Example of Pixel Circuit

According to an aspect of the present invention, the structure of each pixel circuit 110 is not limited to that shown in FIG. 4. Each pixel circuit 110 may have various structures. For example, a TFT 1122 to detect the drain voltage of the TFT 1102 and the correction circuit 1110 to generate the current $I_4$ associated with the detected drain voltage and adding the current $I_4$ to the current $I_2$ flowing through the TFT 1102 are not limited to the structures shown in FIG. 4. Alternatively, an inverting amplifier may be used.

Figure 5:
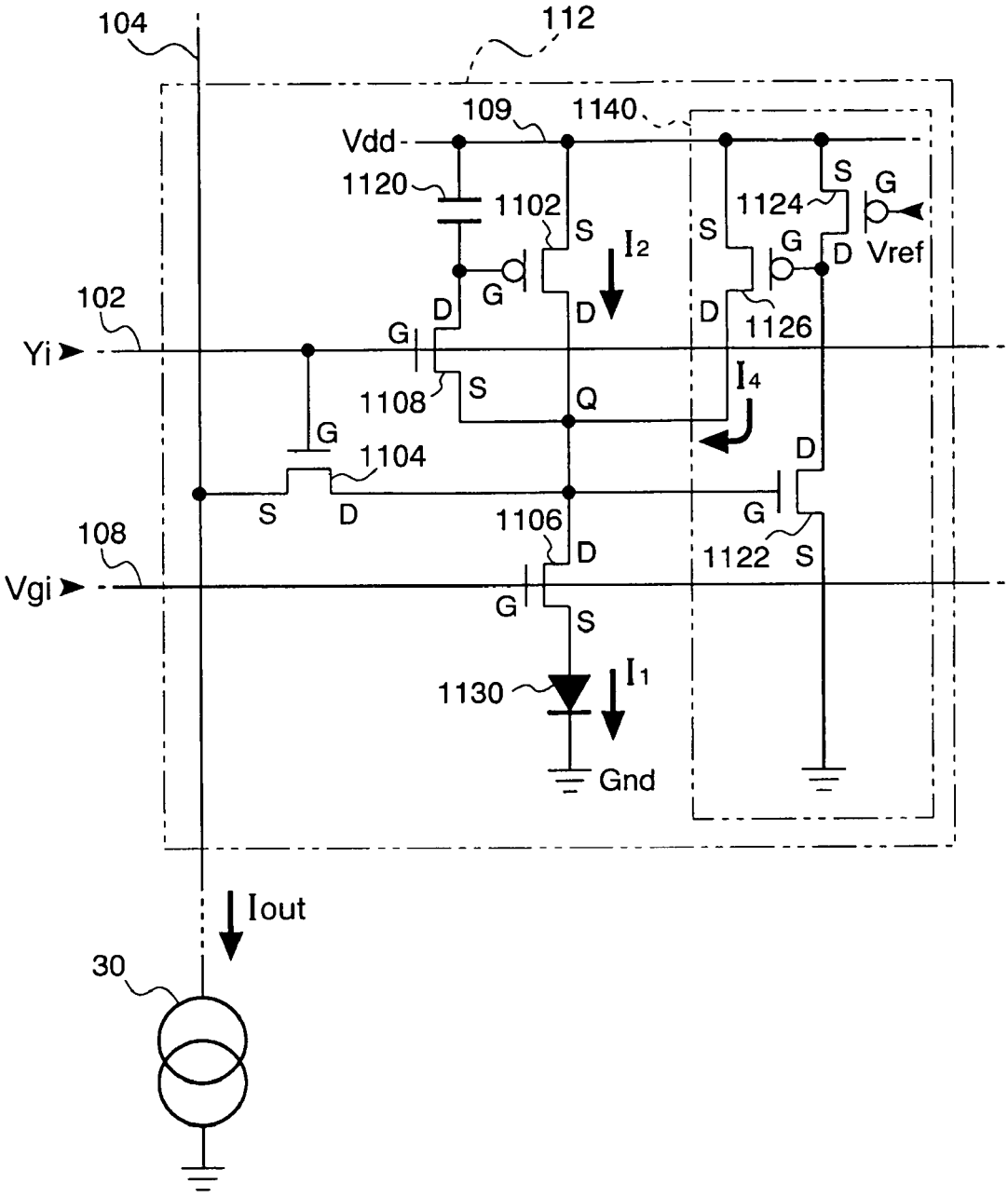
FIG. 5 is a schematic showing another example of the pixel circuit.

FIG. 5 is a schematic showing the structure of a pixel circuit 112 including such an inverting amplifier. In this schematic, an inverting amplifier 1140 includes the n-channel TFT 1122 and p-channel TFTs 1124 and 1126. Of these TFTs, the gate of the TFT 1122 is connected to Q point, and the source of the TFT 1122 is grounded. A reference voltage Vref is supplied to the gate of the TFT 1124. The source of the TFT 1124 is connected to the power line 109, and the drain of the TFT 1124 is connected to the drain of the TFT 1122 and the gate of the TFT 1126. The source of the TFT 1126 is connected to the power line 109, and the drain of the TFT 1126 is connected to Q point. Specifically, in the inverting amplifier 1140, the gate of the TFT 1122 serves as the input, and the drain of the TFT 1126 serves as the output.

In the inverting amplifier 1140, when the drain voltage of the TFT 1102 is increased due to degradation of the organic EL element 1130 (when the absolute value of the voltage between the source and drain of the TFT 1102 is reduced), the ON-resistance of the TFT 1122 is reduced, thereby reducing the voltage at the voltage dividing point between the TFTs 1122 and 1124, that is, the gate voltage of the TFT 1126. As a result, the current $I_4$ flowing between the source and drain of the TFT 1126 is increased. Therefore, in the pixel circuit 112 shown in FIG. 5, as in the pixel circuit 110 including the current mirror circuit, the current $I_1$ flowing through the organic EL element 1130 is made substantially equal to the target value, that is, the current Iout.

With this structure, compared with the current mirror circuit shown in FIG. 4, the ratio of the current $I_4$ to the insufficient current may be adjusted a posteriori by setting the gate voltage Vref of the TFT 1124. 651 The light-emitting control signals Vg1, Vg2, Vg3, . . . , Vgm in FIG. 4 or 5 are described as being generated by inverting the logical level of the corresponding scan signals Y1, Y2, Y3, . . . , Ym. Alternatively, periods in which the light-emitting control signal Vg1, Vg2, Vg3, . . . , Vgm reach an active level (H level) may be narrowed at the same time. Alternatively, the light-emitting control signals Vg1, Vg2, Vg3, . . . , Vgm may be supplied by a circuit other than the scanning-line drive circuit 130 (see FIG. 1).

In the pixel circuit 110 shown in FIG. 4 or the pixel circuit 112 shown in FIG. 5, it has been described that, when the scanning line 102 is selected, current in accordance with the digital value of digital data, that is, the current Iout in accordance with the brightness, is supplied to each corresponding data line 104. Alternatively, voltage in accordance with the brightness may be applied to each corresponding data line 104. Even with this structure, the gate voltage of the TFT 1102 is maintained in the capacitor 1120. As a result, advantages equivalent to those achieved by the structure in which the current Iout in accordance with the brightness is supplied are achieved.

Another Example of Pixel Circuit

In the structures shown in FIGS. 4 and 5, when the scanning line 102 is selected, current in accordance with the brightness of the organic EL element 1130 is allowed to flow through each corresponding data line 104. Alternatively, voltage in accordance with the brightness of the organic EL element 1130 may be applied to each corresponding data line 104.

In the structures shown in FIGS. 4 and 5, when the drain voltage of the TFT 1102 driving the organic EL element 1130 is increased, the current $I_4$ associated with this drain voltage is generated, and the current $I_4$ is added to the current $I_2$ flowing through the TFT 1102. Alternatively, the source voltage of the TFT 1102 may be increased in accordance with the drain voltage of the TFT 1102.

Figure 6:
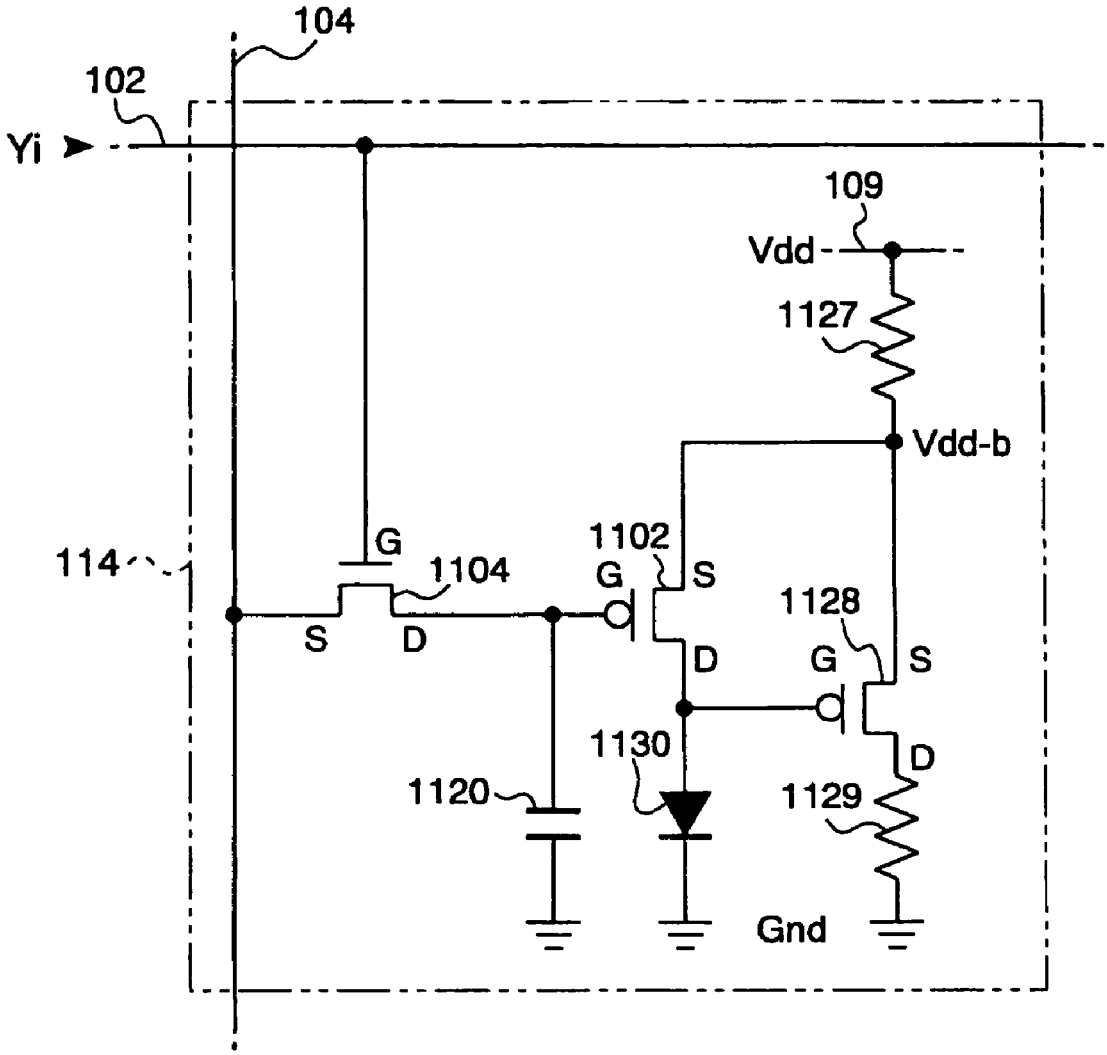
FIG. 6 is a schematic showing another example of the pixel circuit.

FIG. 6 shows a case in which voltage in accordance with the brightness of the organic EL element 1130 is applied to the data line 104. Specifically, FIG. 6 is a schematic showing the structure of a pixel circuit 114 in which the source voltage of the TFT 1102 driving the organic EL element 1130 is increased in accordance with the drain voltage of the, TFT 1102 driving the organic EL element 1130.

In this schematic, a resistor 1127, a p-channel TFT 1128, and a resistor 1129 are connected in series between the power line 109 and a ground wire. The source of the TFT 1102 driving the organic EL element 1130 is connected to the node between the resistor 1127 and the source of the TFT 1128, that is, the voltage dividing point between the power line 109 and the ground wire. At the same time, the gate of the TFT 1128 is connected to the drain of the TFT 1102.

Since the voltage in accordance with the brightness of the organic EL element 1130 is applied to each corresponding data line 104, the data-line drive circuit 140 (see FIG. 3) does not include the current generation circuits 30, but includes voltage generation circuits to generate voltages in accordance with the digital data Dpix-1 to Dpix-n, the voltage generation circuits being associated with the individual data lines 104 (not shown). As described above, one end of the capacitor 1120 may be grounded, as shown in FIG. 6.

Since the pixel circuit 114 includes no TFT 1106, which is provided in the pixel circuits 110 and 112 (see FIGS. 4 and 5) and which is for turning ON the organic EL element 1130 when the scanning line 102 is unselected, the drain of the TFT 1102 is directly connected to the organic EL element 1130. Therefore, the drain voltage of the TFT 1102 is equal to the voltage applied to the organic EL element 1130. 731 With this structure, when the scanning line 102 is selected, the TFT 1104 is turned ON. As a result, the voltage on the data line 104 is applied to the gate of the TFT 1102. Therefore, current in accordance with the voltage applied to the data line 104 flows through the power line 109, the resistor 1127, the TFT 1102, and the organic EL element 1130 in this order. At the same time, charge in accordance with the gate voltage of the TFT 1102 is accumulated in the capacitor 1120.

Subsequently, when this scanning line 102 becomes unselected, the gate of the TFT 1102 is maintained by the capacitor 1120 at the voltage when the scanning line 102 has been selected. As a result, the current in accordance with the voltage applied to the data line 104 continuously flows through the same path.

Even when the drain voltage of the TFT 1102 is increased due to degradation of the organic EL element 1130, the resistance between the source and drain of the TFT 1128 is also increased that much. As a result, the voltage at the voltage dividing point Vdd-b is increased. Even when degradation of the organic EL element 1130 becomes more serious, the current flowing through the organic EL element 1130 is maintained substantially at constant. Even when the ambient temperature changes, similarly the current flowing through the organic EL element 1130 is maintained substantially at constant.

With this structure, the resistance of the resistor 1129 may be set to a large value in order to reduce or prevent power loss due to shoot-through current flowing from the power line 109 to the ground wire. The resistance of the resistor 1127 may be set to a small value in order to suppress the voltage drop. When the resistance between the source and drain of the, TFT 1128 is large, the resistor 1129 may be omitted.

Needless to say, the structure in which the source voltage of the TFT 1102 is increased in accordance with the drain voltage of the TFT 1102 (voltage applied to the organic EL element 1130) may be applied in place of the TFTs 1112, 1114, and 1126 in the pixel circuit 110, although not shown in the figure.

It has been described that, in the pixel circuit 114 shown in FIG. 6, when the scanning line 102 is selected, the voltage in accordance with the brightness is applied to the data line 104. Alternatively, current in accordance with the brightness may be applied to the data line 104.

It is regarded that degradation of the organic EL elements 1130 evenly in the entire display panel 120 becomes more serious, instead of one organic EL element becoming strikingly serious (excluding the case of color display, which will be described later). It is thus unnecessary to detect the drain voltages of the individual TFTs 1102 in all the pixel circuits (voltages applied to the organic EL elements 1130) and to increase the source voltages of the TFTs 1102. A detection pixel circuit may be disposed at a rate of one in a few pixel circuits. In accordance with the drain voltage of the TFT 1102 detected by this pixel circuit, the source voltages of the TFTs 1102 in other pixel circuits may be increased.

Figure 7:
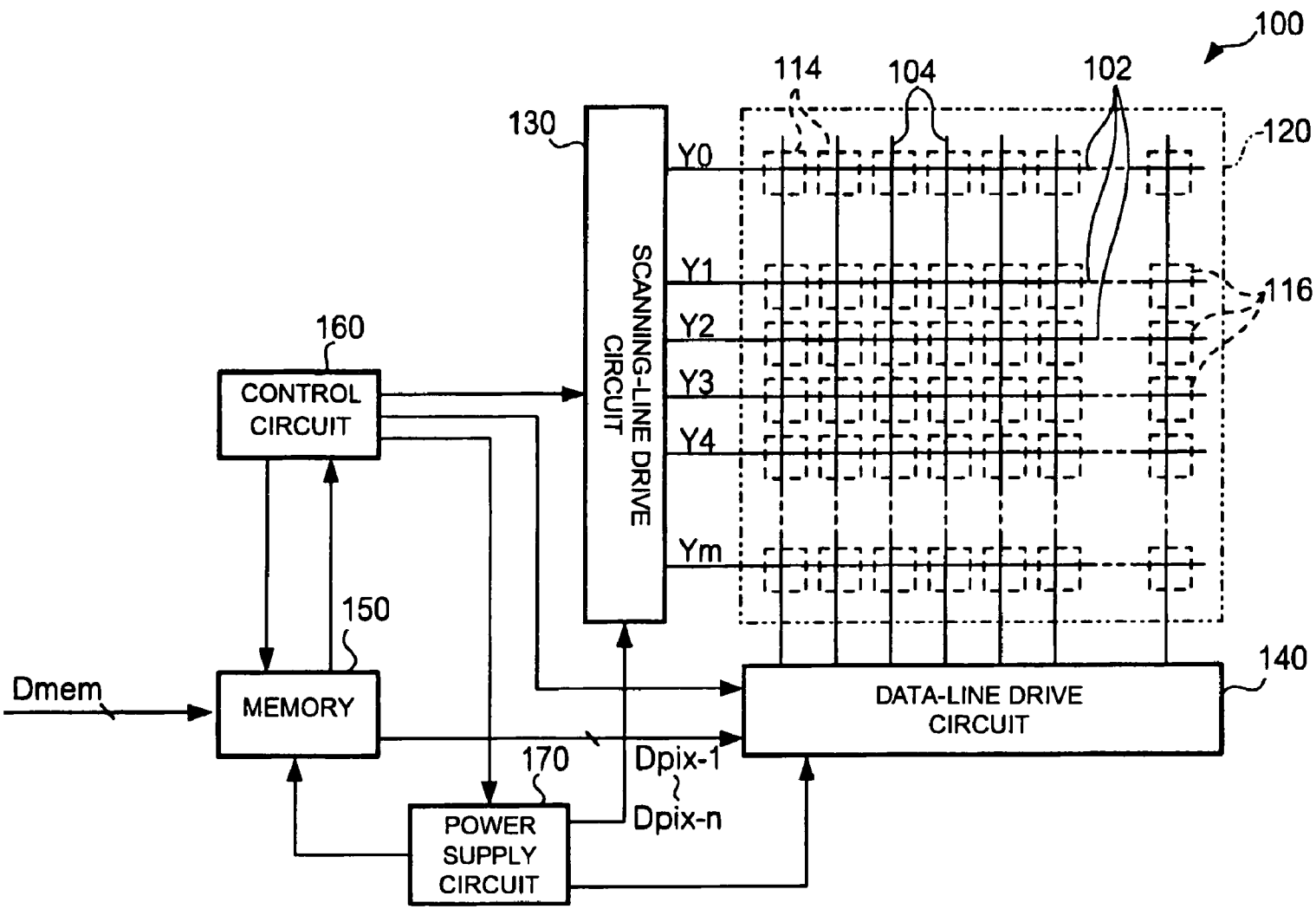
FIG. 7 is a block schematic of an electro-optical device including other examples of pixel circuits.
Figure 8:
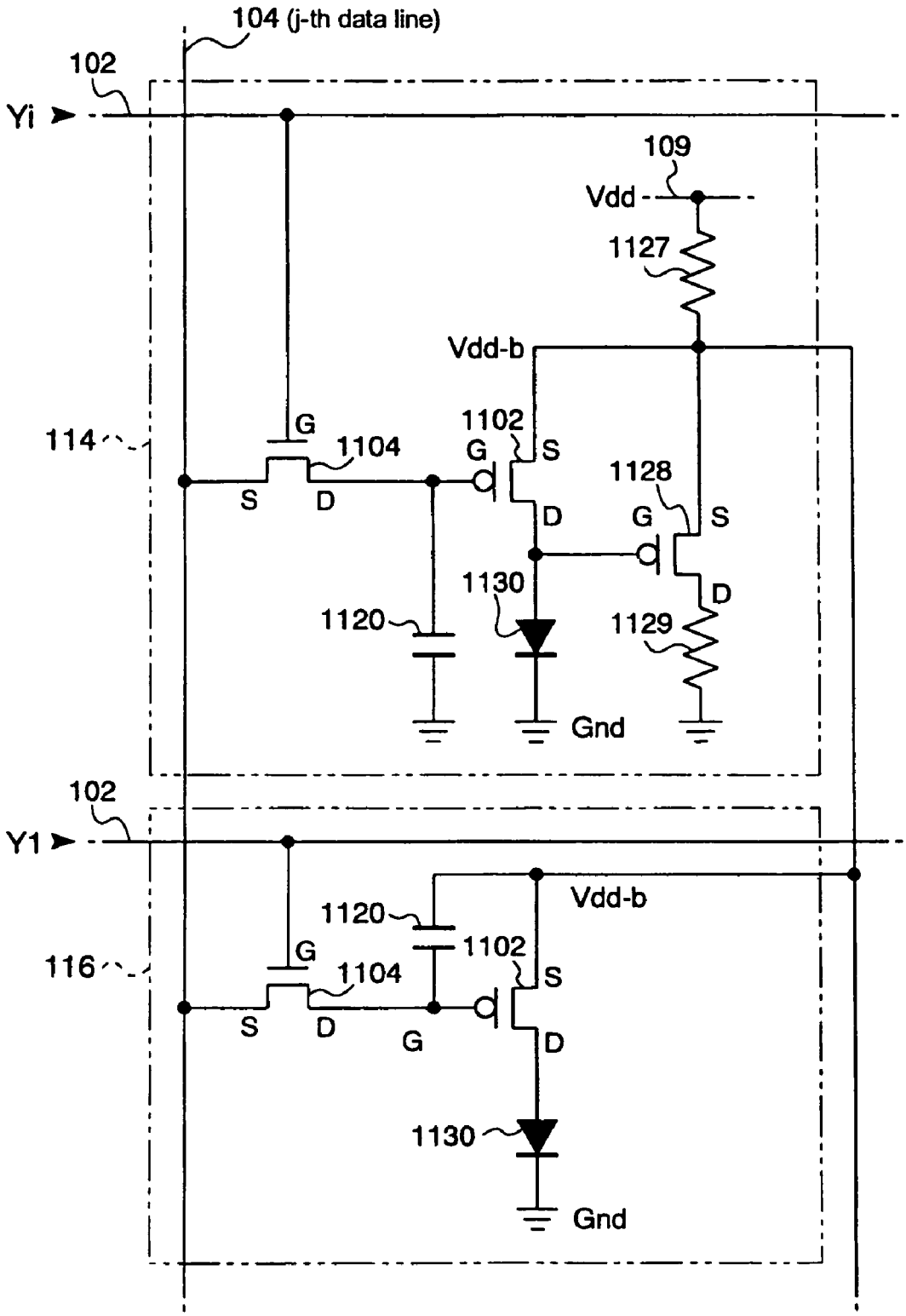
FIG. 8 is a schematic showing the pixel circuits of the electro-optical device.

FIG. 7 is a block schematic showing the structure of an electro-optical device including such pixel circuits. FIG. 8 is a schematic showing the relationship between a detection pixel circuit and a display pixel circuit.

In the electro-optical device 100 shown in FIG. 7, the pixel circuits 114 for detecting the source voltages of the corresponding TFTs 1102 are disposed on the 0-th row, whereas display pixel circuits 116 are disposed on the first to m-th rows. Preferably, the detection pixel circuits 114 on the 0-th row are disposed in, for example, an area in a light-shielding layer (not shown) so that light emitted by the corresponding organic EL elements 1130 will not be detected.

Referring to FIG. 7, the scanning-line drive circuit 130 sequentially selects the 0-th to m-th scanning lines 102 one at a time. The data-line drive circuit 140 applies voltage in accordance with the digital data Dpix-1 to the first data line 104, voltage in accordance with the digital data Dpix-2 to the second data line 104, and, from this point onward, similarly applies voltage in accordance with the digital data Dpix-n to the n-the data line 104.

As shown in FIG. 8, in each column, the voltage Vdd-b adjusted by the pixel circuit 114 at the 0-th row, j-th column is used as the source voltages of the TFTs 1102 in the pixel circuits 116 at the first row, j-th column to the m-th row, j-th column.

With this structure, in the detection pixel circuit 114 at the 0-th row, j-th column, when the drain voltage of the corresponding TFT 1102 is increased due to degradation of the organic EL element 1130, the resistance between the source and drain of the TFT 1128 is also increased that much. Therefore, the voltage at the voltage dividing point Vdd-b is adjusted and increased. This adjusted voltage is applied to the sources of the TFTs 1102 of the display pixel circuits 116 at the first row, j-th column to the m-th row, j-th column. Although the display pixel circuits 116 at the first row, j-th column to the m-th row, j-th column are not provided with detectors for detecting the drain voltages of the TFTs 1102 (voltages applied to the organic EL elements 1130), current flowing through the organic EL elements 1130 is maintained substantially at constant even when degradation of the organic EL elements 1130 becomes more serious or the ambient temperature changes.

To react to changes in the ambient temperature in a more sensitive manner, at least one of the resistors 1127 and 1129 may be replaced with a temperature detector whose resistance varies in accordance with temperature. Alternatively, such a temperature detector may be connected in series or parallel to the resistors 1127 and 1129.

Although the detection pixel circuits 114 are not used as display pixel circuits in the structures shown in FIGS. 7 and 8, the detection pixel circuits 114 may be used as display pixel circuits. Alternatively, instead of providing each column with one detection pixel circuit 114, each row may be provided with one detection pixel circuit. Alternatively, plural columns or plural rows may be provided with one detection pixel circuit. Alternatively, the entirety may be provided with one detection pixel circuit.

When a color image is displayed using organic EL elements emitting red (R), green (G), and blue (B) light, the degree of degradation of the organic EL elements differs from one color to another. Degradation in each color may be detected, and the source voltages of the TFTs 1102 for displaying that color may be adjusted.

Others

The channel type of each TFT may not necessarily be the same as that described above. In the actual use, the p or n channel may be selected appropriately. Depending on selection of the channel type, a negative supply instead of a positive supply may be used. When a negative supply is used, voltage seen from the ground wire becomes negative. Therefore, voltage must be evaluated in absolute value.

Although the organic EL elements 1130 are described as examples of driven elements in the foregoing exemplary embodiment, inorganic EL elements, LED elements, or FED (Field Emission Display) elements may be used.

Electronic Apparatus

Examples of electronic apparatus including the electro-optical device 100 will now be described.

Figure 9:
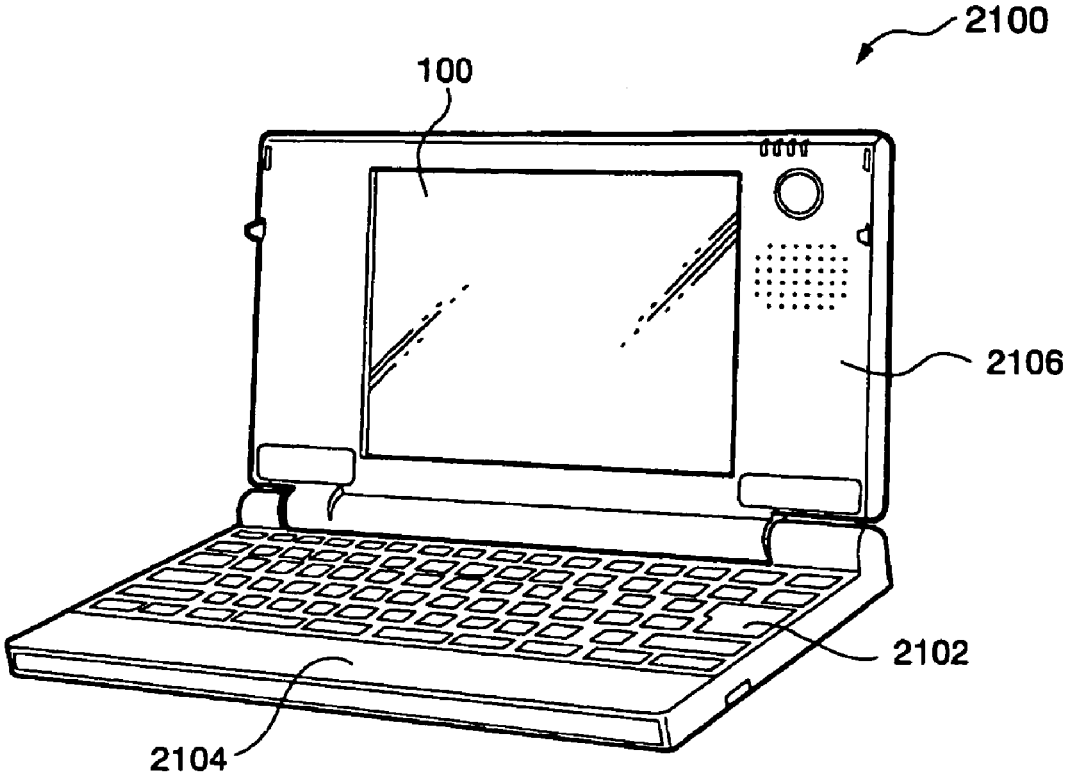
FIG. 9 is an illustration of a personal computer including the electro-optical device.

FIG. 9 is a perspective view of the structure of a mobile personal computer including the electro-optical device 100. In this illustration, a personal computer 2100 includes a main unit 2104 provided with a keyboard 2102 and the electro-optical device 100 serving as a display unit.

Figure 10:
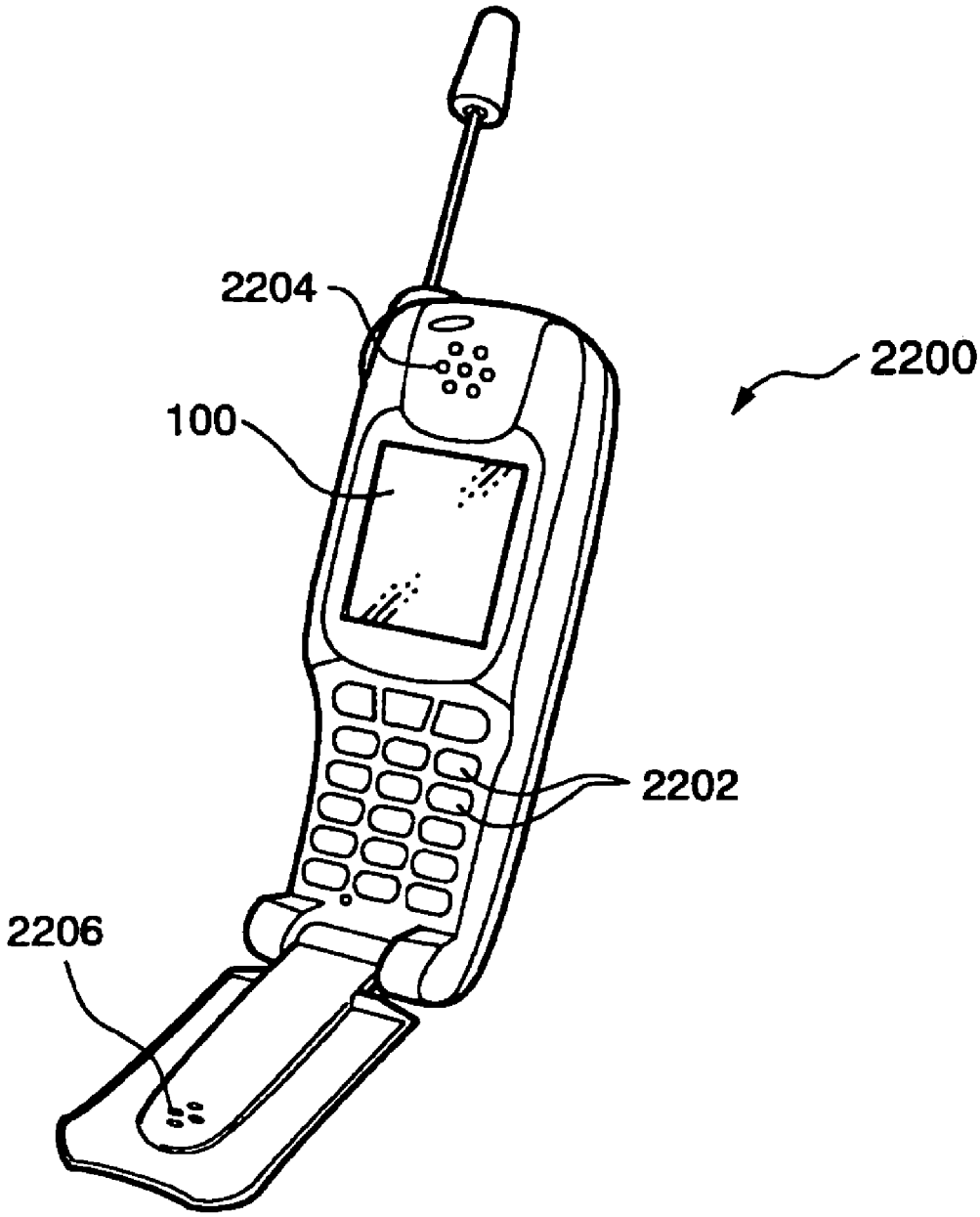
FIG. 10 is an illustration of a cellular phone including the electro-optical device.

FIG. 10 is a perspective view of the structure of a cellular phone including the foregoing electro-optical device 100. In this illustration, a cellular phone 2200 includes a plurality of operation buttons 2202, an earpiece 2204, a mouthpiece 2206, and the foregoing electro-optical device 100.

Figure 11:
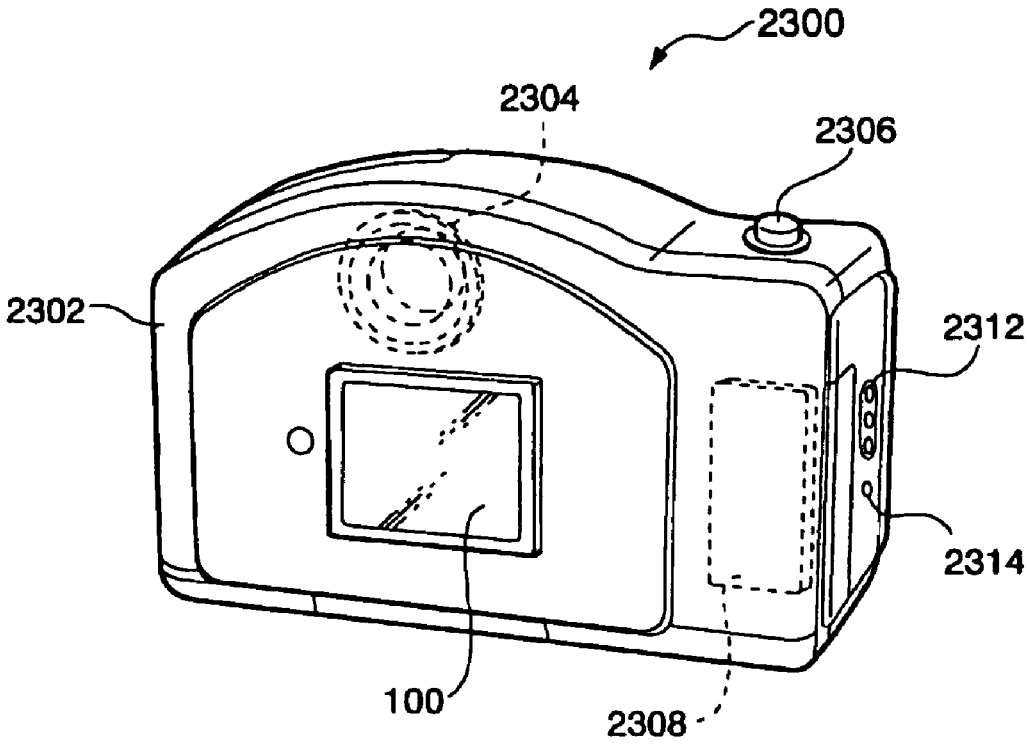
FIG. 11 is an illustration of a digital still camera including the electro-optical device.

FIG. 11 is a perspective view of the structure of a digital still camera including the foregoing electro-optical device 100 serving as a finder. A silver camera exposes film with an optical image of a subject. In contrast, a digital still camera 2300 generates an image-capture signal generated by photoelectric conversion of an optical image of a subject using an image pickup device, such as a CCD (Charge Coupled Device) and stores the generated image-capture signal. The foregoing electro-optical device 100 is placed on the back side of a main unit 2302 of the digital still camera 2300.

Since the electro-optical device 100 displays an image based on the image-capture signal, the electro-optical device 100 functions as a finder displaying an image of the subject. A light-receiving unit 2304 including an optical lens and the CCD is disposed on the front side of the main unit 2302 (back side in FIG. 11).

When a person capturing an image of a subject sees the image displayed on the electro-optical device 100 and presses a shutter button 2306, an image-capture signal at that time is transferred to a memory in a circuit substrate 2308 and is stored.

In this digital still camera 2300, a video signal output terminal 2312 for performing external display and a data communication input/output terminal 2314 are located on a lateral side of the main unit 2302.

In addition to the personal computer shown in FIG. 9, the cellular phone shown in FIG. 10, and the digital still camera shown in FIG. 11, other possible electronic apparatuses provided with the electro-optical device 100 include, for example, a digital television, a viewfinder or monitor-direct-viewing video cassette recorder, a car navigation apparatus, a pager, an electronic notebook, an electronic calculator, a word processor, a workstation, a video phone, a POS terminal, and a device with a touch panel. The foregoing electro-optical device 100 is applicable as a display unit of each of these electronic apparatuses.

As described above, according to an aspect of the present invention, even when the necessary voltage to allow a constant current to flow through a current-driven element, such as an organic EL element, changes due to degradation or ambient temperature, current generated by a drive transistor is corrected by a correction circuit. The current flowing through the driven element is made substantially equal to a target value, thereby reducing or preventing degradation of the quality of a displayed image.

What is claimed is:

1. A pixel circuit disposed at the intersection of a scanning line and a data line, comprising:

a capacitor that accumulates, when the scanning line is selected, charge in accordance with current flowing through the data line or voltage on the data line;

a drive transistor being turned ON/OFF in accordance with the charge accumulated in the capacitor, the drive transistor allowing current to flow between a first terminal and a second terminal of the drive transistor;

a driven element having one end that is electrically connected to the first terminal, the driven element being driven at least by the current allowed to flow by the drive transistor;

a detector that is connected in parallel with the drive transistor and detects voltage at the one end of the driven element, the detector being a detection transistor and a resistance of the detection transistor varying in accordance with the voltage detected by the detector; and a correction circuit that corrects the current flowing through the driven element in accordance with the absolute value of the voltage detected by the detector.

2. The pixel circuit according to claim 1, the correction circuit adding the generated current to the current allowed to flow by the drive transistor.

3. The pixel circuit according to claim 2, the detection transistor having a gate that is connected to the one end of the driven element, the detection transistor being turned ON/OFF in accordance with the gate voltage thereof, and the detection transistor allowing current to flow between a third terminal and a fourth terminal thereof, and the correction circuit generating current associated with current flowing between a first terminal and a second terminal of the detection transistor.

4. The pixel circuit according to claim 3, the correction circuit being a current mirror circuit that generates a mirror current of the current flowing between the third terminal and the fourth terminal.

5. The pixel circuit according to claim 2, the correction circuit inverting and amplifying the voltage detected by the detector and applying the inverted, amplified voltage to the driven element.

6. The pixel circuit according to claim 2, further comprising:

a switch having one end that is connected to the first terminal and having another end that is connected to the one end of the driven element, the switch controlling a connection between the drive transistor and the driven element when the scanning line is unselected, the detector detecting voltage at the one end of the switch, and the correction circuit allowing the generated current to flow through the one end of the switch.

7. The pixel circuit according to claim 1, further comprising:

a switching transistor being turned ON when the scanning line is selected; and a compensation transistor for diode-connecting the drive transistor when the scanning line is selected, the capacitor accumulating, when the switching transistor is turned ON, the charge in accordance with the current flowing through the data line.

8. The pixel circuit according to claim 1, further comprising:

a switching transistor being turned ON when the scanning line is selected, the capacitor accumulating, when the switching transistor is turned ON, the charge in accordance with the voltage on the data line.

9. The pixel circuit according to claim 1, the correction circuit adjusting, when the absolute value of the voltage detected by the detector is large, voltage between the first terminal or the second terminal of the drive transistor and the other end of the driven element by increasing the voltage in terms of absolute value.

10. An electro-optical device, comprising:

a plurality of data lines;

a plurality of scanning lines; and a plurality of pixel circuits as set forth in claim 1, the pixel circuits being disposed at the intersections of the plural data lines and the plural scanning lines.

11. An electronic apparatus, comprising:

an electro-optical device as set forth in claim 10.

12. A pixel circuit comprising:

a drive transistor having a gate that is connected to one end of a capacitor, and a connection between a first terminal and a second terminal of the drive transistor being set in accordance with charge accumulated in the capacitor;

a driven element having one end that is electrically connected to the first terminal;

a detector that is connected in parallel with the drive transistor and detects voltage at the one end of the driven element, the detector being a detection transistor and a resistance of the detection transistor varying in accordance with the voltage detected by the detector; and a correction circuit including an input end to receive a signal indicating the voltage detected by the detector and an output end electrically connected to the first terminal, the correction circuit supplying current in accordance with the absolute value of the voltage indicated by the signal input to the input end to the output end.

13. The pixel circuit according to claim 12, the detection transistor having a gate that is connected to said one end of the driven element, and the connection between a third terminal and a fourth terminal of the detection transistor being set in accordance with the gate voltage thereof.

14. The pixel circuit according to claim 13, the correction circuit including a first transistor having a fifth terminal that is connected to the gate, a sixth terminal that is connected to a power-supply-voltage feed line, and the fifth terminal being connected to the third terminal; and a second transistor having a gate that is connected to the gate of the first transistor and the fifth terminal, a seventh terminal that is electrically connected to the first terminal, and an eighth terminal that is connected to the feed line.

15. The pixel circuit according to claim 13, the correction circuit including: a third transistor, a reference voltage being applied to the gate thereof, a ninth terminal thereof that is connected to the third terminal, and a tenth terminal that is connected to a power-supply-voltage feed line; and a fourth transistor having a gate that is connected to the ninth terminal, an eleventh terminal that is electrically connected to the first terminal, and a twelfth terminal that is connected to the feed line.

16. The pixel circuit according to claim 12, further comprising:

a switch having one end that is connected to the first terminal, and having another end that is connected to said one end of the driven element, the detector detecting voltage at said one end of the switch.

17. The pixel circuit according to claim 12, further comprising:

a compensation transistor that short-circuits between the gate of the drive transistor and the first terminal, the capacitor accumulating charge in accordance with the voltage at the first terminal when the compensation transistor short-circuits between the gate of the drive transistor and the first terminal.

18. An electro-optical device, comprising:

pixel circuits disposed at intersections of a plurality of scanning lines and a plurality of data lines, the pixel circuits including driven elements;

a scanning-line drive circuit that selects the scanning lines one at a time; and a data-line drive circuit that supplies, when the scanning line is selected by the scanning-line drive circuit, current that is to flow through the driven element of each corresponding pixel circuit associated with the scanning line or voltage associated with the current via each corresponding data line, each of the pixel circuits including:

a capacitor that accumulates, when the corresponding scanning line is selected, charge in accordance with current flowing through the corresponding data line or voltage on the corresponding data line;

a drive transistor being turned ON/OFF in accordance with the charge accumulated in the capacitor, the drive transistor allowing current to flow between a first terminal and a second terminal of the drive transistor;

a driven element having one end that is electrically connected to the first terminal, the driven element being driven by at least the current allowed to flow by the drive transistor;

a detector that is connected in parallel with the drive transistor and detects voltage at the one end of the driven element, the detector being a detection transistor and a resistance of the detection transistor varying in accordance with the voltage detected by the detector; and a correction circuit that corrects the current flowing through the driven element in accordance with the absolute value of the voltage detected by the detector.

* * * * *